United States Patent [19]

Stout et al.

[11] Patent Number: 4,531,028

[45] Date of Patent: Jul. 23, 1985

[54] TIMER WITH IMPROVED SWITCH BLADE ARRANGEMENT

[75] Inventors: Garry A. Stout, Bargersville; Donald L. Ray, Oaklandon, both of Ind.

[73] Assignee: Emhart Industries, Inc., Indianapolis, Ind.

[21] Appl. No.: 565,890

[22] Filed: Dec. 27, 1983

[51] Int. Cl.[3] ..... H01H 43/10

[52] U.S. Cl. ..... 200/38 R; 200/38 B; 200/38 C

[58] Field of Search ..... 200/38, 283, 39 R, 39 A, 200/27 R, 27 A, 27 B

[56] References Cited

U.S. PATENT DOCUMENTS

| | | | |
|---|---|---|---|
| 3,599,006 | 8/1971 | Harris | 200/39 R X |
| 3,752,944 | 8/1973 | Cartier et al. | 200/38 C X |
| 4,046,980 | 9/1977 | Rosebrock | 200/38 B X |

*Primary Examiner*—J. R. Scott

*Attorney, Agent, or Firm*—Robert F. Meyer

[57] ABSTRACT

Switches are fixed relative to a camstack for cam actuation and include two individual blades the free ends of which are biased toward the camstack. One of the blades engages the cams to actuate it relative to the other. The free end of the other blade rides on a pivotally mounted carriage which is biased by the hub of the camstack to reference the blade to the hub. The carriage includes individual cam followers which are flexible and which engage the hub to be flexed by the hub. Walls extend from the individual followers between adjacent sets of blades to prevent arcing between adjacent sets of electrical contacts. A third blade also rides on the carriage to be biased by the hub. The third blade provides another switching function.

5 Claims, 6 Drawing Figures

FIG.2
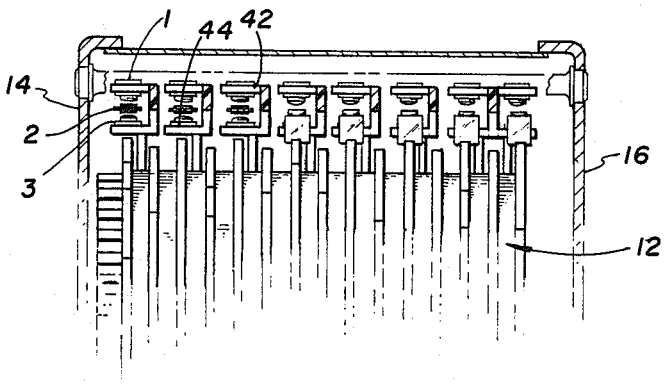
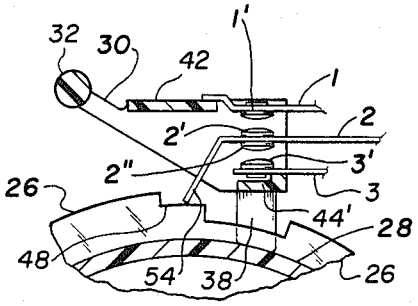
FIG.4
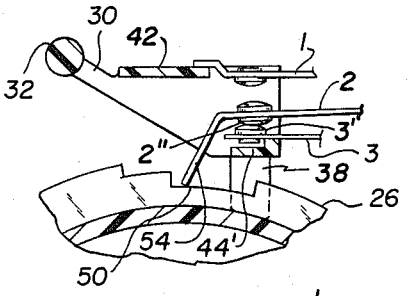
FIG.5
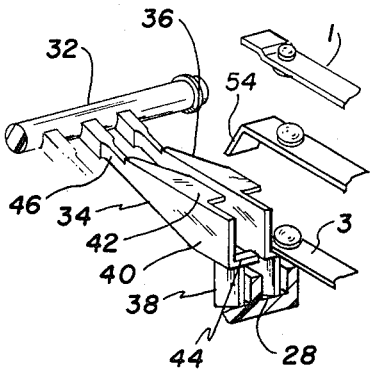
FIG.3
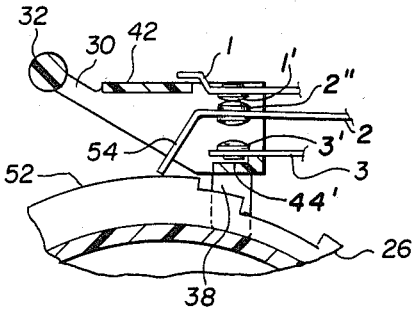
FIG.6

TIMER WITH IMPROVED SWITCH BLADE ARRANGEMENT

BACKGROUND OF THE INVENTION

In U.S. Pat. No. 3,752,944 and British Pat. No. 712,156 there are shown switch blades which provide for more accurate timing of camstacks by having one or two of the blades referenced relative to the camstack hub to accommodate any inaccuracies in the hub shape due to off-center bearings and/or out of roundness. The accurate timing is thereby achieved by maintaining a constant air gap between the electrical contacts of the blades. And in the U.S. patent, accuracy is additionally achieved by having followers molded on the blades. As will be described hereinafter, the timer switch blade arrangement of the present invention provides better air gap control by the manner in which a blade is referenced to the camstack hub, provides more flexibility of timing and increased contact life.

SUMMARY OF THE INVENTION

The improvements are accomplished by providing a timer which in general includes a camstack rotatable about an axis and having a hub portion and individual cams spaced about the hub portion; switch means fixed relative to the camstack for actuation by the cams and including two individual blades the free ends of which are biased toward the camstack, one of the blades engaging the cams to actuate the one blade relative to the other; a carriage pivotally mounted near the free ends and biased by the hub portion, the other of the blades riding on the carriage to reference the other blade to the hub portion; and electrical contacts carried by the two blades selectively engaging one another.

DESCRIPTION OF THE DRAWINGS

FIG. 2 is a view taken along the line 2—2 of FIG. 1 with the ends of three sets of blades removed for clarity.

FIG. 3 is an enlarged exploded view of a portion of a timer.

FIGS. 4–6 are enlarged views of the switch blades showing their relationship to the timer's camstack in three different operating positions.

DETAILED DESCRIPTION OF THE INVENTION

Figure 1:
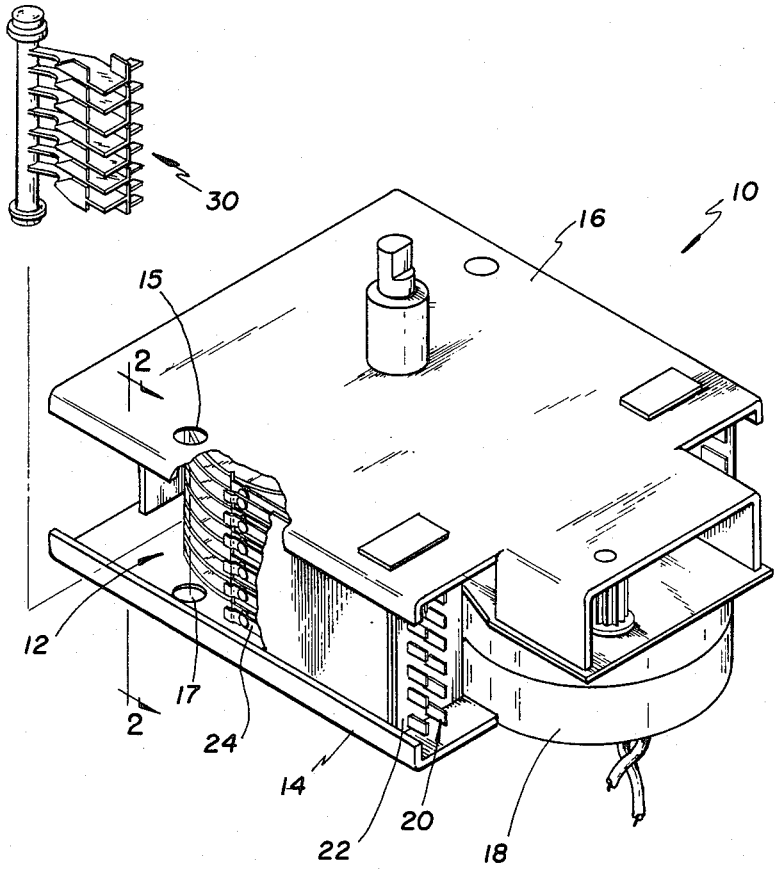
FIG. 1 is an isometric view of a timer utilizing the improved structure of the invention.

Referring to FIG. 1 there is shown a timer 10 employing the improved structure of the invention. A camstack 12 is rotatably journalled between end plates 14 and 16 of housing 15 and are rotatably driven by a synchronous motor 18 in a manner well known in the art. A plurality of switch blades 20 with electrical terminals are fixedly carried in a terminal block 22 so that their free ends 24 are located relative to the camstack for actuation by its cams to open and close electrical circuits.

Referring to FIGS. 2 and 4, each individual switch is composed of three blades 1, 2 and 3 with blade No. 2 riding on a cam surface 26 of an individual cam of the camstack. As will be more completely described, blades 1 and 3 are referenced off of the camstack hub 28 to provide a constant air gap between the electrical contacts 1', 2', 2'', and 3'. Referring to FIGS. 1, 2 and 4, the means used to reference blades 1 and 3 to the hub includes a carriage 30 which is pivotally mounted between end plates 14 and 16 in apertures 15 and 17. As more clearly shown in FIG. 3, carriage 30 includes a rod 32 that is pivotally mounted between the end plates and a series of individual followers 34 and 36. Each follower has a foot 38 which engages the hub of the camstack and also includes a wall 40 extending from post 38 for preventing arcing between adjacent sets of contacts. Each follower includes a pair of seats 42 and 44 upon which the ends of the blades 1 and 3 ride. Seat 44 includes a recess 44' (FIG. 5) which serves as a relief for contact 3'. The followers are individually flexible at neck portion 46 so that they may individually compensate for any inaccuracies in the surface of hub 28. It has been found that with this structure better air gap control is achieved by having the foot 38 located near rod 32 rather than having a foot attached to a blade which is cantilevered from terminal block 20 as is done in U.S. Pat. No. 3,752,944. Better flexibility of timing can be achieved since blades 1 and 3 merely ride on the followers so that they can be adjusted to increase or decrease air gaps to obtain special timing. And in addition, increased contact life is achieved through the follower acting as a shock absorber with respect to blade 3 to reduce double arcing through continued contact bounce.

The operation of the blades can be described with reference to FIGS. 4–6. As shown, in all three operating modes, foot 38 rides on hub 28 of the camstack to reference blades 1 and 3 to the hub. In FIG. 4, blade 2 has engaged a middle level cam lobe 48 through its cam follower 54 to open all the contacts. In FIG. 5, blade 2 has dropped to a bottom lobe 50 to engage contacts 2'' and 3', while in FIG. 6, blade 2 has engaged an upper cam lobe 52 to engage contacts 2' and 1'. As shown in FIG. 6, blade 1 has been lifted from seat or shelf 42 such that it is not referenced to the hub portion when the contacts are closed.

We claim:

1. A timer including a housing and a camstack rotatable about an axis within said housing and having a hub portion and cams spaced about said hub portion;

switch means carried in said housing and located for actuation by said cams and including two individual blades the free ends of which are biased toward said camstack, one of said blades engaging said cams to actuate said one blade relative to the other of said blades;

a carriage including a rod carried by said housing near said free ends and individual followers extending from said rod and engaging said hub portion, said followers being individually flexible with respect to said rod as they are biased by said hub portion; the other of said blades riding on said carriage to reference said other blade to said hub portion, and electrical contacts carried by said two blades selectively engaging one another.

2. A timer according to claim 1 wherein said individual followers include neck portions to render them flexible.

3. A timer according to claim 1 wherein said rod is pivotally mounted by said housing.

4. A timer according to claim 3 wherein said individual followers include a wall extending between adjacent sets of blades to prevent arcing between said set of blades.

5. A timer according to claim 1 further including a third blade having an electrical contact engaging an electrical contact of said one blade engaging said cam, the free end of said third blade riding on said carriage to reference said third blade to said hub portion.

* * * * *